US007024892B2

(12) United States Patent
Blakely

(10) Patent No.: US 7,024,892 B2
(45) Date of Patent: Apr. 11, 2006

(54) TWO-PLY BODY-SMOOTHING UNDERGARMENT

(75) Inventor: Sara T. Blakely, 800-A E. Morningside Dr., Atlanta, GA (US) 30324

(73) Assignee: Sara T. Blakely, Atlanta, GA (US)

( * ) Notice: Subject to any disclaimer, the term of this patent is extended or adjusted under 35 U.S.C. 154(b) by 0 days.

(21) Appl. No.: 10/126,570

(22) Filed: Apr. 19, 2002

(65) Prior Publication Data

US 2003/0196252 A1 Oct. 23, 2003

(51) Int. Cl.
*D04B 9/00* (2006.01)

(52) U.S. Cl. ..... 66/177

(58) Field of Classification Search ..... 2/69, 2/400, 406, 403, 409; 450/94, 156; 66/8, 66/178 R, 179, 182
See application file for complete search history.

(56) References Cited

U.S. PATENT DOCUMENTS

| | | | | |
|---|---|---|---|---|
| 3,625,029 A | * | 12/1971 | Safrit et al. | 66/142 |
| 3,937,040 A | | 2/1976 | Negri | |
| 4,041,736 A | | 8/1977 | Fregeolle | |
| 4,059,973 A | | 11/1977 | Gresillon | |
| 4,100,624 A | | 7/1978 | Davis | |
| 4,390,999 A | | 7/1983 | Lawson et al. | |
| 5,255,393 A | | 10/1993 | Brady | |
| 5,572,888 A | | 11/1996 | Browder, Jr. et al. | |
| 5,590,548 A | | 1/1997 | Osborne | |
| 5,671,615 A | | 9/1997 | Kj.ae butted.rgaard et al. | |
| 5,746,068 A | | 5/1998 | Popa et al. | |
| 5,902,170 A | | 5/1999 | Ganz | |
| 5,954,564 A | | 9/1999 | Ganz | |
| 6,055,674 A | | 5/2000 | Imboden et al. | |
| 6,119,491 A | * | 9/2000 | Pinelli | 66/177 |
| 6,151,927 A | | 11/2000 | Owens et al. | |

FOREIGN PATENT DOCUMENTS

| | | |
|---|---|---|
| CH | 360 360 | 2/1962 |
| FR | 2 184 543 | 12/1973 |
| FR | 2 744 339 | 8/1997 |
| FR | 2 785 176 | 5/2000 |
| GB | 1 320 047 | 6/1973 |
| JP | 10060706 | 3/1998 |

* cited by examiner

*Primary Examiner*—Danny Worrell

(57) ABSTRACT

A body-smoothing lower-body undergarment is constructed by circularly knitting a pair of seamless two-ply fabric tubes, longitudinally slitting an upper portion of each tube for a distance generally corresponding to a desired rise of the undergarment so as to form two fabric edges, and joining the two fabric edges of one of the fabric tubes to the two fabric edges of the other fabric tube so as to form a single larger fabric tube that serves as a panty portion of the undergarment, while lower portions of the fabric tubes serve as legs of the undergarment. The two-ply construction allows the bottoms of the legs to be formed without leg bands. The undergarment preferably has a 1×1 vertical rib knit construction, a turned welt waistband, and an abdominal control panel.

19 Claims, 2 Drawing Sheets

TWO-PLY BODY-SMOOTHING UNDERGARMENT

FIELD OF THE INVENTION

The present invention relates to lower-body undergarments for providing a smooth appearance beneath clothing.

BACKGROUND OF THE INVENTION

In the apparel industry, significant effort has been expended toward developing undergarments that provide a slimming and smoothing of the abdomen, buttocks, hips, and thighs. Many different approaches have been taken toward this end. Women sometimes wear regular pantyhose to get a slimming and smoothing effect, but pantyhose have drawbacks. For instance, pantyhose are readily visible when worn with skirts or open-toe shoes, which is undesirable if the wearer wants the bare-leg look. Pantyhose also can be uncomfortable during warm or hot weather because they completely cover the legs.

Short body-smoothing undergarments having legs that end above the knee have been developed to try to overcome the above problems. Many undergarments of this type have an elastic band at the bottom of each leg. The leg band provides a finished appearance to the fabric edge and prevents raveling, and also constricts against the wearer's leg to hold the leg of the garment in place so that it doesn't ride up during use. Such leg bands can be uncomfortable because they can dig into the wearer's legs, and can leave unsightly marks on the legs that may persist for some time after removal of the garment. The short body-smoothing undergarments generally also include an elastic cord sewn into the waistband, which can also dig in and create marks. Such leg bands and waistbands can also be readily visible beneath clothing because of their tightness against the body, which can create a bulge at the transition between the band and the uncovered part of the leg or waist.

Another drawback with some known body-smoothing undergarments is that they are designed to be worn in addition to panties, or are made in such a way that many women are reluctant to wear them without panties. This can partially defeat the purpose of the undergarment because the panties may create visible panty lines beneath the wearer's clothing.

Some panty-like body-shaping undergarments employ a gusset that is entirely or predominately synthetic such as nylon or polyester so as to save on the cost of the garment. Such gussets in many cases do not have adequate moisture-absorbency and breathability, and hence can lead to discomfort and unhealthy conditions.

SUMMARY OF THE INVENTION

The present invention in its various aspects addresses the above problems with prior body-shaping undergarments, by providing an undergarment and method for making an undergarment, in which the legs of the undergarment are free of bottom leg bands, for improved comfort and a smooth transition between the bottom edges of the legs and the uncovered portion of the wearer's legs. Despite the lack of leg bands, the legs of the undergarment do not tend to ride up during use.

Thus, in accordance with a preferred embodiment of the invention, each of the legs of the undergarment is formed as a seamless two-ply fabric tube having a tubular inner ply and a tubular outer ply. The two plies are connected to each other by being knit continuously to each other at a bottom edge of the leg. In other words, one ply is knit from the top of the tube down to the bottom edge and then the knitting direction is reversed and the other ply is knit back up from the bottom edge to the top, so that essentially one long fabric tube is folded double so that the inner ply lies against the inner surface of the outer ply. This construction allows conventional bottom leg bands to be eliminated and the lower edge of the leg to lie flat against the wearer's skin so that it is not readily visible beneath clothing. The legs of the undergarment preferably terminate above the wearer's knees.

To keep the legs of the undergarment from riding up, in preferred embodiments at least the legs, and preferably the entire garment, is knit with a vertical rib knit. The preferred knit construction is a 1×1 rib knit. This construction has been found to resist riding up of the legs, despite the lack of leg bands.

Preferably, the undergarment includes a two-ply panty portion that is formed in two halves. Each half of the panty portion is seamlessly and continuously knit to a corresponding one of the legs. More particularly, each leg and its panty half are fashioned from a two-ply seamless fabric tube. An upper portion of each tube is slit longitudinally for a distance dictated by a desired rise of the undergarment (i.e., the distance from crotch to waistband), thus producing two fabric edges for each tube. The two fabric edges of one tube are joined to those of the other tube to form a single larger tube that serves as the panty portion. Preferably, a separately formed gusset panel is sewn into the panty portion between a portion of the edges of one tube and corresponding portions of the edges of the other tube; the gusset panel preferably is formed entirely or predominately from cotton or other absorbent and breathable material.

The undergarment has a waistband that preferably is formed as a turned welt knit from elasticized yarns such as covered spandex yarns, which preferably are also used for knitting the panty portion and legs of the garment. Thus, each two-ply fabric tube has a turned welt knit to its upper end, and the welts of the tubes are slit and joined together to form the waistband. This allows the usual elastic cord to be eliminated, which improves the comfort of the waistband as well as its appearance beneath close-fitting clothing. Although the integrally knitted waistband is preferred, alternatively the waistband can be separately formed and then sewn onto the garment, or can be formed in any other suitable way.

The undergarment in preferred embodiments includes a front panel having a greater resistance to stretching than the rest of the undergarment, the front panel thus providing increased body shaping for the abdominal region of the wearer. The enhanced body shaping of the front panel preferably is provided by knitting the front panel with a tighter knit than the rest of the garment. When the legs and panty halves are knit as seamless circularly knit fabric tubes that are subsequently slit and joined together, a portion of each fabric tube is knit with a tighter knit than the rest of the tube. The tighter-knit portion extends for only a portion of the circumference of the tube, and extends longitudinally only for the part of the tube that will become a panty half. After the upper portions of the tubes are slit, the tighter-knit portions of the tubes are joined together to form the front panel of the panty portion. The rear part of the panty portion thus has a longer length than that of the front part, since the same number of courses are knit in the rear part as in the front part, but the knit is tighter over the front panel. Accordingly, the front part becomes shorter than the rear. In this way, the rear of the panty portion is able to accommodate the curvature of the buttocks, such that the waistband tends not to be pulled down when the wearer sits or bends over.

The undergarment in accordance with the preferred embodiment of the present invention thus overcomes the drawbacks of prior body-smoothing undergarments noted above. The undergarment can be worn in place of panties if desired, such that no panty lines are visible beneath close-fitting clothing. The bottoms of the legs of the garment are not readily visible beneath clothing because there are no leg bands, and the bottoms of the legs lie flat against the wearer's skin. The waistband does not dig in and presents a smooth appearance beneath clothing because the usual elastic cord has been eliminated. The undergarment has a minimum of seams. The undergarment thereby provides a smooth appearance while not revealing the fact that the wearer is wearing a body-smoothing undergarment.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE INVENTION

Figure 1:
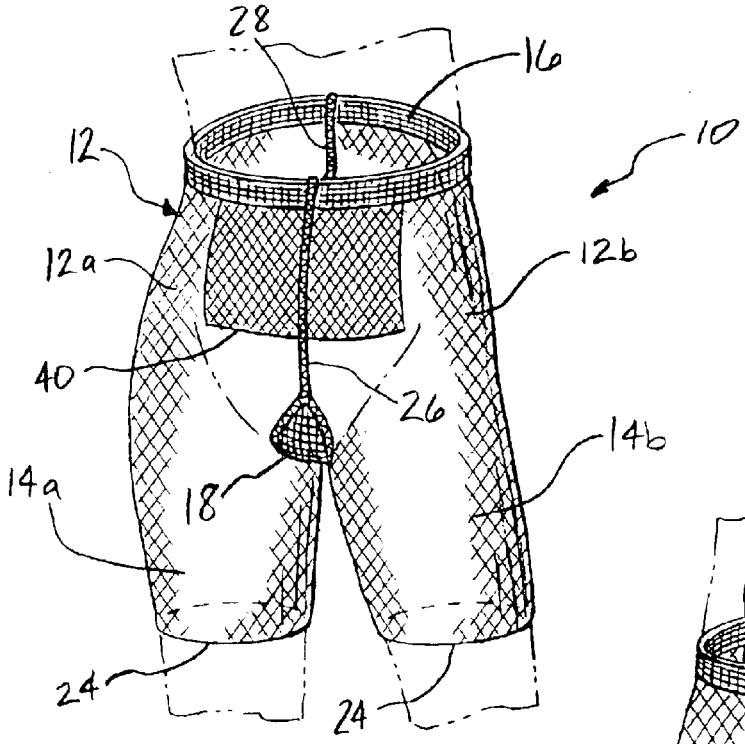
FIG. 1 is a perspective view, generally from the front, showing a person wearing an undergarment in accordance with a preferred embodiment of the invention.
Figure 2:
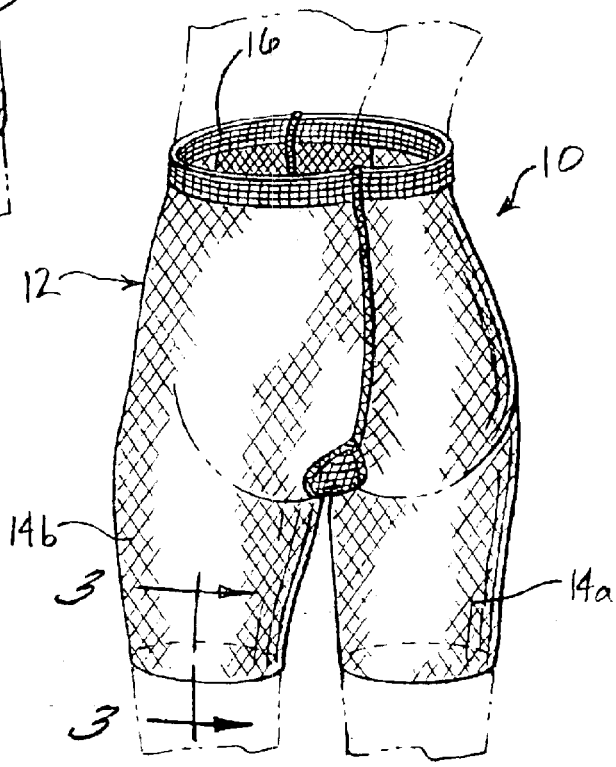
FIG. 2 is a perspective view, generally from the rear, showing a person wearing the undergarment of FIG. 1.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

An undergarment 10 and a method for constructing the undergarment in accordance with one preferred embodiment of the invention are illustrated in FIGS. 1 through 6. The undergarment 10 is knit from yarns and includes a panty portion 12 that encircles the lower torso and extends between the legs of the wearer, and a pair of legs 14*a* and 14*b* that are connected with the panty portion and that extend at least part of the way down the wearer's thighs.

The panty portion 12 includes a waistband 16. The panty portion also preferably includes a separately formed gusset panel 18 sewn into the panty portion.

Figure 3:
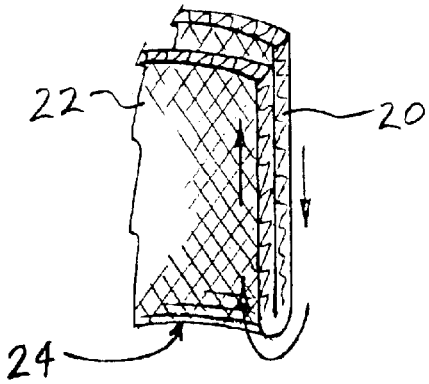
FIG. 3 is a detail view of a lower portion of one leg of the undergarment.

In accordance with the invention, the legs 14*a,b* of the undergarment are formed as two-ply fabric tubes that are seamless. As illustrated in FIG. 3, each leg comprises a seamless tubular outer ply 20 and a seamless tubular inner ply 22. The two plies preferably are continuously knit to each other along a circumferentially extending line 24 at the bottom edge of the leg; thus, the inner ply 22 is a continuous extension of the outer ply and is folded about the line 24 so as to lie against the inner surface of the outer ply 20. The line 24 defines the bottom edge of the leg of the undergarment. The legs formed in this manner do not require leg bands as in some prior undergarments. The plies in the vicinity of the bottom of each leg preferably are not connected to each other except at the line 24.

Although it is preferable to have the plies in the vicinity of the lower end of each leg unconnected to each other except at the line 24 defining the lower edge of the leg, it is also possible to connect the plies to each other at one or more locations, if desired. For example, the plies could be knit together for one or a few courses at a location spaced above the bottom edge of the leg (e.g., at a location spaced ½-inch or so above the bottom edge), with the plies otherwise being unconnected. This alternative does not change the general characteristic of the leg being a two-ply construction without a leg band (i.e., without a separately formed and attached leg band).

In preferred embodiments of the invention, each leg is formed on a circular knitting machine having cylinder needles and dial needles. One of the plies of the leg is knit, such as with the cylinder needles, beginning at the upper end and proceeding down to the lower end of the leg; the knitting is then transferred to the dial needles, which knit the other ply from the lower end back up to the upper end. The arrows in FIG. 3 illustrate the direction in which knitting proceeds.

The panty portion 12 of the undergarment preferably is formed in two halves, a right half 12*a* and a left half 12*b* (as seen from the wearer's perspective), that are joined together along a front seam 26 and a rear seam 28. The right panty half 12*a* preferably is a continuous extension of the right leg 14*a* such that there is no seam required to join the panty half 12*a* to the leg 14*a;* likewise, the left panty half 12*b* is an extension of the left leg 14*b*. Thus, the panty portion 12 is a two-ply structure.

Figure 4:
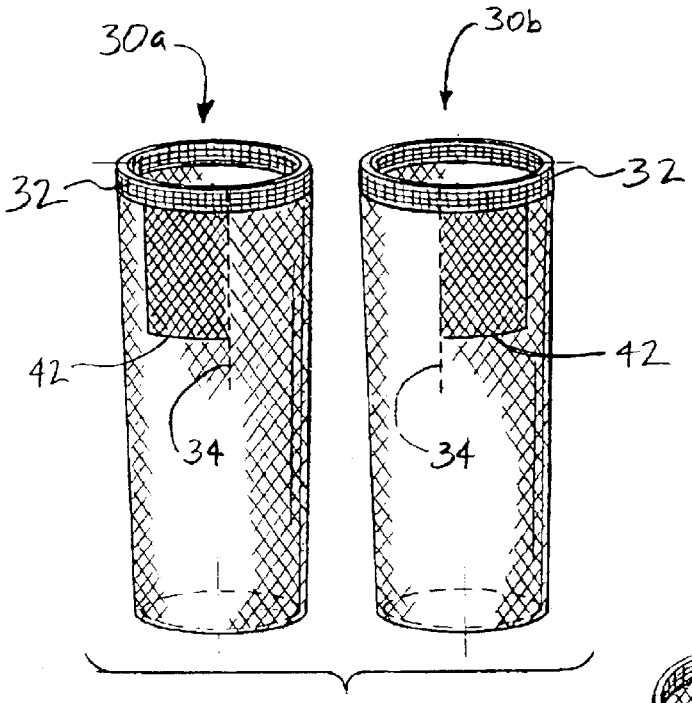
FIG. 4 is a perspective view showing a pair of two-ply fabric tubes used to construct the legs and corresponding halves of the panty portion of an undergarment in accordance with the invention.
Figure 5:
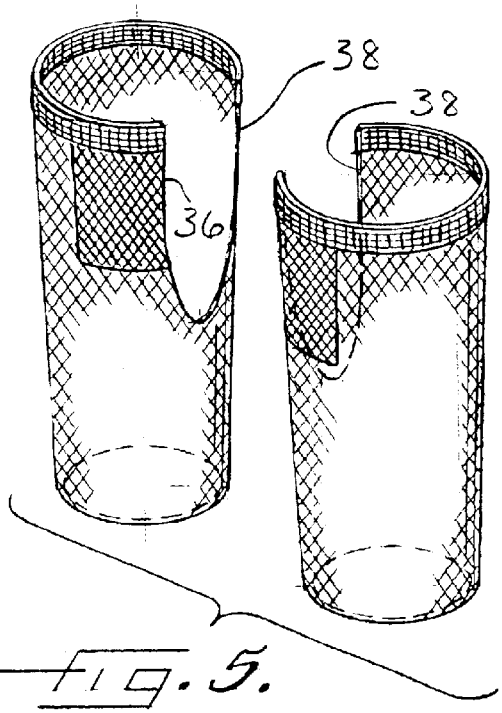
FIG. 5 is a view showing the fabric tubes slit longitudinally for part of their lengths.
Figure 6:
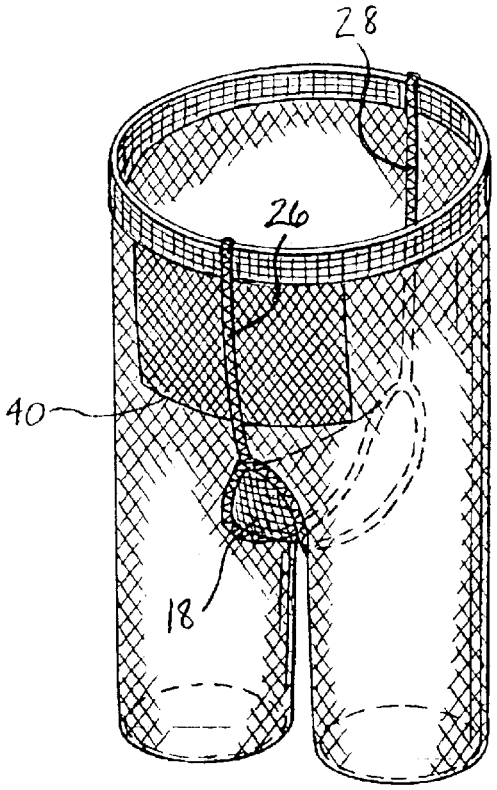
FIG. 6 is a view showing the two slit fabric tubes sewn together to form a finished undergarment.

FIGS. 4 through 6 illustrate a preferred method of making an undergarment in accordance with the invention. The method begins by circularly knitting a pair of two-ply fabric tubes 30*a* and 30*b* in the manner previously described. Preferably, a turned welt 32 is knit to the upper end of each tube. The upper end portion of each tube is longitudinally slit along a line 34. The length of the slit line 34 is dictated by the desired rise, i.e., the distance from the crotch to the waistband, of the undergarment. After slitting the tubes, the tubes appear as shown in FIG. 5. Thus, each tube has a front edge 36 and a rear edge 38 formed as a result of the slitting. The front edge 36 of one tube is joined to the front edge 36 of the other tube (thereby forming the front seam 26), and likewise the rear edges 38 of the tubes are joined together (thereby forming the rear seam 28), thus forming a single larger tube that serves as the panty portion of the undergarment. The turned welts 32 of the two fabric tubes thus are joined together to form the waistband 16 of the finished undergarment.

Preferably, a separately made gusset panel 18 is sewn into the panty portion between the two tubes to form a gusset. This enables the fit in the crotch region of the undergarment to be improved, and also allows the gusset to be formed of a different material from that of the rest of the undergarment. Preferably, the gusset panel 18 is formed of a breathable and absorbent material such as cotton or a cotton/synthetic blend.

The joining of the two fabric tubes to each other and to the gusset panel preferably is effected by sewing. A flat stitch seam can be used if desired, with the flat side of the seam facing outward away from the wearer's body, so that the seams are not readily visible beneath close-fitting clothing. Alternatively, other types of seams can be used.

If desired, the two fabric tubes 30*a,b* can be slit in such a manner that a small amount of material of each tube is removed prior to joining the tubes together. This can allow the girth of the panty portion to be reduced, for example, relative to what it would be if no material were removed. The removal of material can also allow the gusset panel to fit better into the panty portion without puckering or folding.

The undergarment 10 preferably is knit to include elastic yarns such as nylon covered spandex. A particularly preferred undergarment is knit exclusively from such yarns (except for the gusset panel, as previously noted). A suitable yarn, for example, is a 60 denier LYCRA® SOFT yarn available from Dupont.

The undergarment preferably is knit with a vertical rib knit (i.e., such that the ribs extend lengthwise in the top to bottom direction of the undergarment). A particularly preferred knit construction is a 1×1 rib knit. It has been found that such a knit construction aids in reducing the tendency for the legs of the undergarment to ride up during wear. In a conventional undergarment having bottom leg bands, the leg bands are largely responsible for preventing the legs from riding up, but this is achieved at the expense of reduced comfort as well as visibility of the leg bands beneath close-fitting clothing. Elimination of the leg bands in the present undergarment thus might be expected to result in a greater tendency of the legs to ride up, and in fact such a result can occur if the knit construction of the undergarment is not carefully selected. The vertical rib knit construction of the undergarment results in a greatly reduced tendency of the legs to ride up.

It is also preferred that the panty portion 12 of the undergarment include a front panel 40 positioned to overlie the abdominal area of the wearer. The front panel 40 has a greater resistance to stretching than the rest of the panty portion 12. The front panel 40 thus provides "tummy control". The greater resistance to stretching of the front panel 40 can be achieved in various ways. In preferred embodiments of the invention, the front panel 40 is knit from the same yarns and with the same knit construction as the rest of the panty portion but is knit with a tighter knit. The tighter knit results in a greater resistance to stretching. The tighter knit also provides a secondary benefit, namely, the front of the panty portion becomes shorter (i.e., has a smaller rise) than the back of the panty portion. Stated differently, the back of the panty portion is longer than the front, and thus the back is able to accommodate the natural curvature of the buttocks without the back of the waistband being pulled down relative to the front. This has been found to result in a reduced tendency for the back of the panty portion to be pulled down when the wearer sits or bends over.

To provide the tighter-knit front panel, each of the two-ply fabric tubes 30*a,b* is knit so that there is a tighter-knit portion 42 of each tube positioned at the upper end of the tube adjacent the turned welt 32. The tighter-knit portion 42 extends longitudinally for a distance corresponding to the desired height of the tummy control panel 40, and extends circumferentially for a distance corresponding to about half the desired width of the control panel 40. When the tubes are slit, each slit line 34 extends along one edge of the tighter-knit portion 42, as shown in FIG. 4. Thus, when the tubes are joined together, the two tighter-knit portions 42 are joined to form the control panel 40.

The undergarment in accordance with the present invention thus addresses a number of desires in a body-smoothing undergarment. The undergarment is comfortable and is not readily visible beneath clothing because the normally required leg bands have been eliminated in favor of two-ply legs continuously knit together at the bottoms of the legs so they lie flat against the wearer's skin, the number of seams in the garment have been minimized (and, in particular, there are no leg seams), and the conventional waistband having a sewn-in elastic cord has been eliminated in favor of a turned welt waistband. Furthermore, because of the inclusion of a separately formed gusset made from a breathable and absorbent fabric such as cotton, the undergarment may be better from the standpoint of vaginal health than some prior body-smoothing undergarments that do not include such breathable and absorbent gussets; additionally, the breathable and absorbent gusset allows the undergarment to be worn in place of panties rather than in addition to panties, and hence the phenomenon of "visible panty lines" beneath clothing can be avoided.

Many modifications and other embodiments of the invention will come to mind to one skilled in the art to which this invention pertains having the benefit of the teachings presented in the foregoing descriptions and the associated drawings. For example, although it is not a preferred construction, the panty portion of the undergarment could be formed separately from the legs and then sewn to the legs. The front abdominal control panel could be formed by altering the knit construction or in some other way so as to give the panel a greater resistance to stretching, as opposed to using a tighter knit to achieve this effect. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A lower-body undergarment, comprising:

a pair of legs each comprising a two-ply seamless fabric tube, each leg having a seamless tubular inner ply and a seamless tubular outer ply connected thereto at a bottom edge of the leg, the legs being free of separately formed and attached bottom leg bands, the legs having a length such that the lower edges of the legs encircle a wearer's legs; and a two-ply panty portion connected to the legs, where in least the legs comprise a vertical rib knit fabric.

2. The lower-body undergarment of claim 1, wherein the two-ply panty portion comprises a first panty half that is continuously knit with and seamlessly connected to a first of the legs, and a second panty half that is integrally knit with and seamlessly connected to a second of the legs, the first and second panty halves being joined to each other along a front seam and a back seam.

3. The lower-body undergarment of claim 2, wherein each panty half includes a waistband portion.

4. The lower-body undergarment of claim 3, wherein each leg and the panty half seamlessly connected thereto are formed of a circularly knit two-ply fabric tube that is knit starting at an upper end of the panty half and proceeding down to the lower edge of the leg and then back up to the upper end of the panty half, the panty halves then being slit longitudinally and joined together to form the panty portion.

5. The lower-body undergarment of claim 4, wherein the waistband portion of each panty half comprises a turned welt knit to the upper end of the panty half.

6. A lower-body undergarment, comprising:

a pair of legs each comprising a two-ply seamless fabric tube, each leg having a seamless tubular inner ply and a seamless tubular outer ply connected thereto at a bottom edge of the leg, the legs being free of separately formed and attached bottom leg bands, the legs having a length such that the lower edges of the legs encircle a wearer's legs; and a two-ply panty portion connected to the legs, wherein the two-ply panty portion comprises a first panty half that is continuously knit with and seamlessly connected to a first of the legs, and a second panty half that is integrally knit with and seamlessly connected to a second of the legs, the first and second panty halves being joined to each other along a front seam and a back seam, wherein each panty half includes a waistband portion, wherein each leg and the panty half seamlessly connected thereto are formed of a circularly knit two-ply fabric tube that is knit starting at an upper end of the panty half and proceeding down to the lower edge of the leg and then back up to the upper end of the panty half, the panty halves then being slit longitudinally and joined together to form the panty portion, and wherein at least the legs comprise a vertical rib knit fabric.

7. A lower-body undergarment, comprising:

a pair of legs each comprising a two-ply seamless fabric tube, each leg having a seamless tubular inner ply and a seamless tubular outer ply connected thereto at a bottom edge of the leg, the legs being free of separately formed and attached bottom leg bands, the legs having a length such that the lower edges of the legs encircle a wearer's legs; and a two-ply panty portion connected to the legs, wherein the two-ply panty portion comprises a first panty half that is continuously knit with and seamlessly connected to a first of the legs, and a second panty half that is integrally knit with and seamlessly connected to a second of the legs, the first and second panty halves being joined to each other along a front seam and a back seam, wherein each panty half includes a waistband portion, wherein each leg and the panty half seamlessly connected thereto are formed of a circularly knit two-ply fabric tube that is knit starting at an upper end of the panty half and proceeding down to the lower edge of the leg and then back up to the upper end of the panty half, the panty halves then being slit longitudinally and joined together to form the panty portion, and wherein the legs and panty portion both comprise a vertical rib knit fabric.

8. The lower-body undergarment of claim 7, wherein the vertical rib knit fabric comprises a 1×1 rib knit.

9. The lower-body undergarment of claim 1, wherein the panty portion and legs are knit from the same types and sizes of yarns.

10. The lower-body undergarment of claim 1, wherein the legs are sized in length such that the lower edges of the legs are above the knees of a wearer.

11. A body-smoothing lower-body undergarment, comprising:

a panty portion formed of right and left panty halves joined together; and right and left legs respectively connected to the right and left panty halves of the panty portion, each leg and the corresponding panty half being formed from a seamless circularly knit two-ply fabric tube, wherein at least the legs comprise a vertical rib knit fabric.

12. The body-smoothing lower-body undergarment of claim 11, further comprising a gusset panel formed separately from the panty halves and legs and sewn thereto.

13. The body-smoothing lower-body undergarment of claim 11, wherein the two-ply fabric tube that forms each leg comprises a tubular inner ply folded about a fold line onto an inner surface of a tubular outer ply, the fold line forming a lower edge of the leg, whereby the legs are free of bottom leg bands.

14. A body-smoothing lower-body undergarment, comprising:

a panty portion formed of right and left panty halves joined together; and right and left legs respectively connected to the right and left panty halves of the panty portion, each leg and the corresponding panty half being formed from a seamless circularly knit two-ply fabric tube, wherein the two-ply fabric tube that forms each leg comprises a tubular inner ply folded about a fold line onto an inner surface of a tubular outer ply, the fold line forming a lower edge of the leg, whereby the legs are free of bottom leg bands and wherein the two-ply fabric tubes are knit with a vertical rib knit construction.

15. A body-smoothing lower-body undergarment, comprising:

a panty portion formed of right and left panty halves joined together; and right and left legs respectively connected to the right and left panty halves of the panty portion, each leg and the corresponding panty half being formed from a seamless circularly knit two-ply fabric tube, wherein the two-ply fabric tube that forms each leg comprises a tubular inner ply folded about a fold line onto an inner surface of a tubular outer ply, the fold line forming a lower edge of the leg, whereby the legs are free of bottom leg bands, and wherein the panty portion and legs are knit with a 1×1 rib knit construction.

16. A method for making a lower-body undergarment, comprising:

circularly knitting a first seamless two-ply fabric tube and longitudinally slitting an upper portion thereof for a distance generally corresponding to a desired rise of the undergarment so as to form two fabric edges;

circularly knitting a second seamless two-ply fabric tube and longitudinally slitting an upper portion thereof for said distance generally corresponding to said desired rise of the undergarment so as to form two fabric edges; and joining the two fabric edges of the first fabric tube to the two fabric edges of the second fabric tube so as to form a single larger fabric tube from the upper portions of the first and second fabric tubes, the single larger fabric tube serving as a panty portion of the undergarment, and lower portions of the first and second fabric tubes serving as legs of the undergarment, wherein at least the legs comprises a vertical rib knit fabric.

17. The method of claim 16, further comprising knitting a turned welt to an upper end of each of the first and second fabric tubes, slitting the turned welts along with the fabric tubes, and joining the turned welts together to form a waistband for the undergarment.

18. The method of claim 16, wherein each of the fabric tubes is knit beginning at an upper end of the tube proceeding down to a lower end thereof to form a tubular first ply, and then back up to the upper end to form a tubular second ply.

19. The method of claim 18, wherein the lower end of each of the fabric tubes is formed as a simple fold between an inner ply and an outer ply of the fabric tube such that the legs are free of bottom leg bands.

* * * * *